United States Patent [19]

Kato

[11] 4,138,918

[45] Feb. 13, 1979

[54] AUTOMATIC MUSICAL INSTRUMENT

[75] Inventor: Hiroshi Kato, Ageo, Japan

[73] Assignees: Kabushiki Kaisha Kawai Gakki Seisakusho, Hamatsu; Sanyo Denki Kabushiki Kaisha, Moriguchi; Tokyo Sanyo Denki Kabushiki Kaisha, Gumna, all of Japan

[21] Appl. No.: 794,233

[22] Filed: May 5, 1977

[51] Int. Cl.[2] ..... G10H 1/00

[52] U.S. Cl. ..... 84/1.03; 84/DIG. 12; 84/DIG. 22

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| 3,889,568 | 6/1975 | Amaya | 84/1.01 |
| 3,929,051 | 12/1975 | Moore | 84/1.17 |
| 3,986,424 | 10/1976 | Sakashita | 84/1.03 |

*Primary Examiner*—Robert K. Schaefer

*Assistant Examiner*—Vit W. Misra

*Attorney, Agent, or Firm*—Haseltine, Lake, & Waters

[57] ABSTRACT

An automatic musical instrument in which a chord discrimination and a musical performance circuit are arranged so that a comparator with multiple input terminals on one side, is connected to a memory circuit having multiple basic types of chords memorized. The comparator has multiple input terminals on the other side connected to key switches through a shift register. The comparator, furthermore, has a control electrode connected to a clock pulse generator which is connected, in turn, to multiple input terminals of the memory circuit, by way of two counter circuits. The latter have multiple output terminals connected, respectively, to two latch circuits. The comparator has an output terminal connected to control electrodes of the latch circuits. The musical performance circuit has a decoder connected to multiple output terminals of one of the latch circuits.

5 Claims, 4 Drawing Figures

Amplifier
Filter
Envelope Circuit
Rhytm Pulse Generator
Frequency Divider
Tone Source Signal Oscillators
Decoder
Latch Circuit
Clock Pulse Generator
Shift Register
Comparator
Memory Circuit
Counter
Counter
Decoder
Nil
Nil Clock Pulse Generator
5
6
Counter
6a
6b
6c
6d
7
Counter
7a
8
Latch Circuit
9
Latch Circuit
10
16
4
Memory
3
Comparator
2
Shift Register
1-1
1-2
1-12
17
18
60
Adder
61
62
A B C D
62a
62b
62c
62d
Memory
63a
63b
63c
64
65
Rhythm Pulse Generator
65b
65h
66
Timing Pulse Generator
67
Decoder
67-1
67-2
67-22
68-1
68-2
68-22
69-1
69-2
69-22
Gate
70
Envelope Circuit

AUTOMATIC MUSICAL INSTRUMENT

BACKGROUND OF THE INVENTION

The present invention relates to an automatic musical instrument with a chord discrimination circuit and a musical performance circuit.

It has been usual, up to the present time, with this kind of apparatus, that a memory circuit provided in the chord discrimination circuit, is of such type that it memorizes all of the various chords which are to be generally used. Thus the memory circuit becomes large in size and is complex in construction.

Accordingly, it is an object of the present invention to provide apparatus free of the above defects.

Another object of the present invention is to provide an automatic musical instrument of the foregoing character which is substantially simple in construction and may be economically fabricated.

A further object of the present invention is to provide an automatic musical instrument which may be readily maintained in service and which has a substantially long operating life.

SUMMARY OF THE INVENTION

The objects of the present invention are achieved by providing that the chord discrimination circuit is so constructed that a comparator is connected at its multiple input terminals on one side to a memory circuit in which basic types of chords are memorized, and at its multiple input terminals on the other side to multiple key-switches through a shift register. It is further connected at its control electrode to a clock pulse generator, which is connected to multiple input terminals of the above-mentioned memory circuit through first and second counter circuits. Multiple output terminals of these first and second counter circuits are connected respectively to first and second latch circuits. An output terminal of the above-mentioned comparator is connected to control electrodes of these first and second latch circuits.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
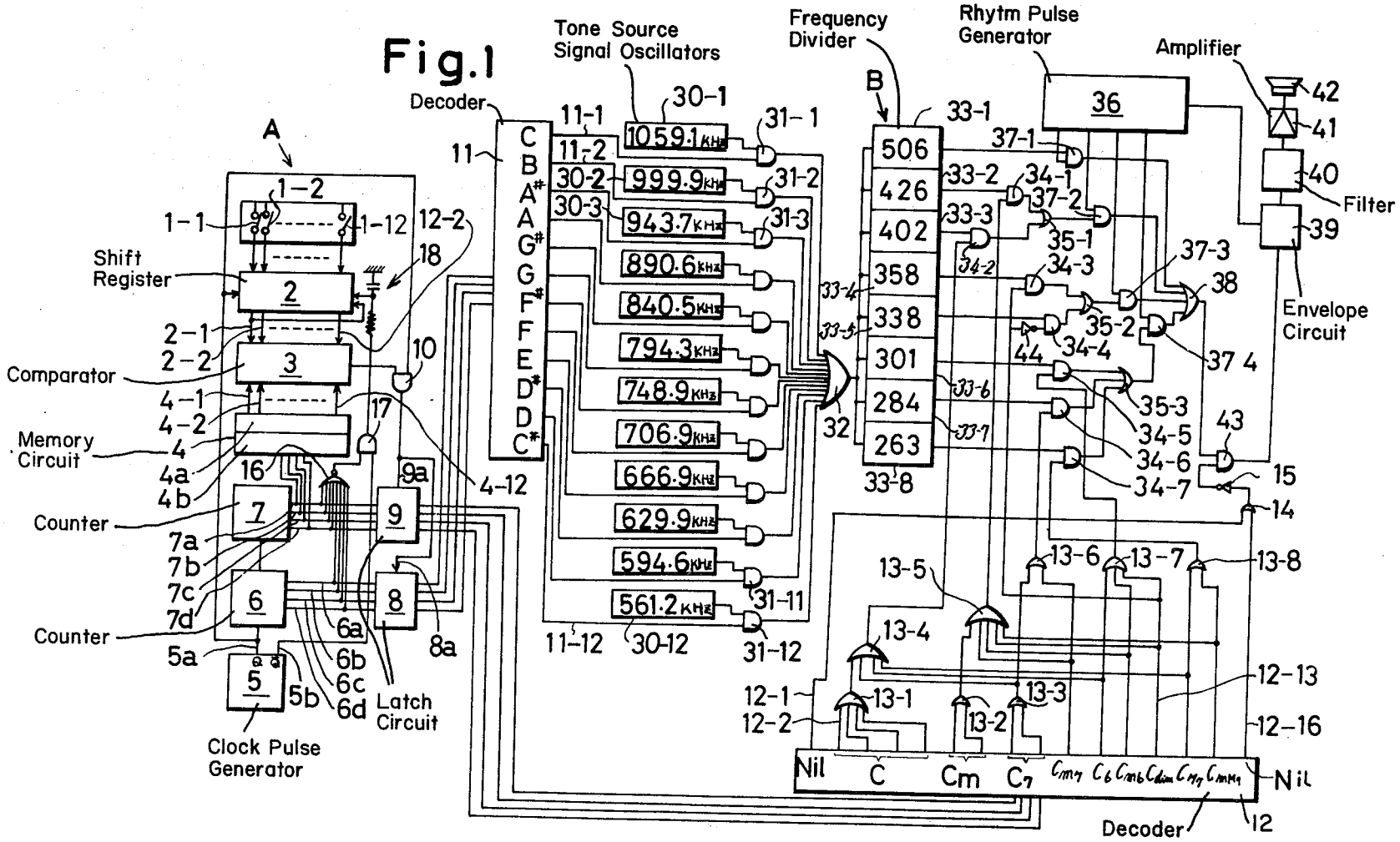
FIG. 1 is a block diagram showing one embodiment of the present invention.

FIG. 1 shows one embodiment of the present invention in which A denotes a chord discrimination circuit.

In this chord discrimination circuit A, numerals 1-1, 1-2 . . . 1-12 denote key-switches arranged to be closed by depression of keys, and numeral 2 denotes a shift register connected to its output terminals. Multiple output terminals 2-1, 2-2 . . . 2-12 of the shift register 2 are connected to multiple input terminals on one side of a comparator 3. Reference numeral 4 denotes a memory circuit, and multiple output terminals 4-1, 4-2 . . . 4-12 thereof are connected to multiple input terminals on the other side of the comparator 3.

Reference numeral 5 denotes a clock pulse generator, and an output 5*a* from it is connected to a control electrode of the shift register 2 and also to input terminals of the memory circuit 4 through first and second counter circuits 6, 7. Multiple input terminals 6*a* . . . 6*d*, 7*a* . . . 7*d* of these first and second counter circuits 6, 7 are connected to first and second latch circuits 8, 9. Control electrodes 8*a*, 9*a* thereof are connected through a connecting circuit to an output terminal of the comparator 3. Numeral 10 denotes an AND circuit interposed between comparator 3 at its one side input terminal and its output terminal in the foregoing connecting circuit. Another input terminal of circuit 10 is connected to an output terminal of the clock pulse generator 5 so that coincidence signals synchronized with clock pulses (described in detail hereinafter) may be applied to the first and second latch circuits 8, 9.

The first and second counter circuits 6, 7 each comprises multiple flip-flop circuits, and has a 12:16 frequency dividing ratio. The above-mentioned shift register 2 comprises an endaround shift register.

The foregoing memory circuit 4 comprises matrix circuit 4*a* and decoder 4*b*, having a timing pulse generating circuit. The matrix circuit 4*a* is composed of a read-only memory. In this read-only memory, basic types of any kind of chords, that is, various types of C chords, for instance, as shown in Table 1 are memorized.

TABLE 1

| Adress | Tone Name Chord | C | C# | D | D# | E | F | F# | G | G# | A | A# | B |
|---|---|---|---|---|---|---|---|---|---|---|---|---|---|
| 1 | Nil | 0 | 0 | 0 | 0 | 0 | 0 | 0 | 0 | 0 | 0 | 0 | 0 |
| 2 | C | 1 | 0 | 0 | 0 | 0 | 0 | 0 | 0 | 0 | 0 | 0 | 0 |
| 3 | C | 1 | 0 | 0 | 0 | 1 | 0 | 0 | 0 | 0 | 0 | 0 | 0 |
| 4 | C | 1 | 0 | 0 | 0 | 0 | 0 | 0 | 1 | 0 | 0 | 0 | 0 |
| 5 | C | 1 | 0 | 0 | 0 | 1 | 0 | 0 | 1 | 0 | 0 | 0 | 0 |
| 6 | Cm | 1 | 0 | 0 | 1 | 0 | 0 | 0 | 0 | 0 | 0 | 0 | 0 |
| 7 | Cm | 1 | 0 | 0 | 1 | 0 | 0 | 0 | 1 | 0 | 0 | 0 | 0 |
| 8 | $C_7$ | 1 | 0 | 0 | 0 | 1 | 0 | 0 | 0 | 0 | 0 | 1 | 0 |
| 9 | $C_7$ | 1 | 0 | 0 | 0 | 1 | 0 | 0 | 1 | 0 | 0 | 1 | 0 |
| 10 | $Cm_7$ | 1 | 0 | 0 | 1 | 0 | 0 | 0 | 1 | 0 | 0 | 1 | 0 |
| 11 | $C_6$ | 1 | 0 | 0 | 0 | 1 | 0 | 0 | 1 | 0 | 1 | 0 | 0 |
| 12 | $Cm_6$ | 1 | 0 | 0 | 1 | 0 | 0 | 0 | 1 | 0 | 1 | 0 | 0 |
| 13 | C dim | 1 | 0 | 0 | 1 | 0 | 0 | 1 | 0 | 0 | 1 | 0 | 0 |
| 14 | C $M_7$ | 1 | 0 | 0 | 0 | 1 | 0 | 0 | 1 | 0 | 0 | 0 | 1 |
| 15 | Cm $M_7$ | 1 | 0 | 0 | 1 | 0 | 0 | 0 | 1 | 0 | 0 | 0 | 1 |

TABLE 1-continued

| Adress | Tone Name Chord | C | C# | D | D# | E | F | F# | G | G# | A | A# | B |
|---|---|---|---|---|---|---|---|---|---|---|---|---|---|
| 16 | Nil | 1 | 1 | 1 | 1 | 1 | 1 | 1 | 1 | 1 | 1 | 1 | 1 |

Accordingly, though described in detail hereinafter, by means of timing pulses generated in sequence from the decoder 4*b*, respective chords are selected in sequence so as to be obtained as digital signals from the output terminals 4-1 . . . 4-12.

All the major chords, if represented in digital form, are as shown in the following Table 2.

TABLE 2

| Tone Name Chord | | C | C# | D | D# | E | F | F# | G | G# | A | A# | B |
|---|---|---|---|---|---|---|---|---|---|---|---|---|---|
| C | major | 1 | 0 | 0 | 0 | 1 | 0 | 0 | 1 | 0 | 0 | 0 | 0 |
| C# | " | 0 | 1 | 0 | 0 | 0 | 1 | 0 | 0 | 1 | 0 | 0 | 0 |
| D | " | 0 | 0 | 1 | 0 | 0 | 0 | 1 | 0 | 0 | 1 | 0 | 0 |
| D# | " | 0 | 0 | 0 | 1 | 0 | 0 | 0 | 1 | 0 | 0 | 1 | 0 |
| E | " | 0 | 0 | 0 | 0 | 1 | 0 | 0 | 0 | 1 | 0 | 0 | 1 |
| F | " | 1 | 0 | 0 | 0 | 0 | 1 | 0 | 0 | 0 | 1 | 0 | 0 |
| F# | " | 0 | 1 | 0 | 0 | 0 | 0 | 1 | 0 | 0 | 0 | 1 | 0 |
| G | " | 0 | 0 | 1 | 0 | 0 | 0 | 0 | 1 | 0 | 0 | 0 | 1 |
| G# | " | 1 | 0 | 0 | 1 | 0 | 0 | 0 | 0 | 1 | 0 | 0 | 0 |
| A | " | 0 | 1 | 0 | 0 | 1 | 0 | 0 | 0 | 0 | 1 | 0 | 0 |
| A# | " | 0 | 0 | 1 | 0 | 0 | 1 | 0 | 0 | 0 | 0 | 1 | 0 |
| B | " | 0 | 0 | 0 | 1 | 0 | 0 | 1 | 0 | 0 | 0 | 0 | 1 |

(Here, "1" is a state in which a key is depressed, and "0" is a state in which a key is not depressed).

It will be clear from the above table that the C major chord "100010010000" becomes the B major chord "000100100001", A# major chord "001001000010" . . . if shifted to the left step by step. This can be similarly applied to all kinds of chords such as minor chords, 7th chords, minor 7th chords and others.

Referring to the drawings, B shows one example of a musical performance circuit, wherein numerals 30-1 . . . 30-12 denote tone source signal oscillators different in oscillation frequency. The oscillation frequencies of these oscillators 30-1 . . . 30-12 are as shown on the drawings. Output terminals of these oscillators 30-1 . . . 30-12 are connected to OR circuit 32 through respective AND circuits 31-1 . . . 31-12, and an output terminal of the OR circuit 32 is connected to a frequency divider for 1sts 33-1; to a frequency divider for minor 3rds 33-2, to a frequency divider for major 3rds 33-3; to a frequency divider for diminished 5ths 33-4, to a frequency divider for perfect 5th 33-5, to a frequency divider for 6ths 33-6, to a frequency divider for minor 7ths 33-7, and to a frequency divider for major 7ths 33-8. The frequency dividing ratios of these frequency dividers 33-1 . . . 33-8 are as shown on the drawings.

The frequency divider for minor 3rds 33-1 and the frequency divider for major 3rds 33-3, the frequency divider for diminished 5ths 33-4 and the frequency divider for perfect 5ths 33-5, and the frequency divider for 6ths 33-6, the frequency divider for minor 7ths 33-7 and the frequency divider for major 7ths 33-8 are connected, respectively, to OR circuits 35-1 . . . 35-3 through respective AND gates 34-1 . . . 34-7. Additionally, output terminals of the frequency divider for 1sts 33-1 and these OR circuits 35-1 . . . 35-3 are connected to AND gates 37-1 . . . 37-4 arranged to be controlled by rhythm pulses generated from rhythm pulse generator 36.

Output terminals of these AND gates 37-1 . . . 37-4 are connected in common through OR circuit 38 for connection to speaker 42 through envelope circuit 39, filter 40 and amplifier 41.

Further, multiple output terminals of the first latch circuit 8 in the chord discrimination circuit A are connected to a binary-coded 12-decimal decoder 11. Multiple output terminals 11-1 . . . 11-12 of the decoder 11 are connected to respective control electrodes of the forego AND gates 31-1 . . . 31-12. Further, multiple output terminals of the second latch circuit 9 are connected to a binary-coded 16 decimal decoder 12. The 2nd to the 15th output terminals 12-1 . . . 12-15 of decoder 12 are connected to the AND gates 34-1 . . . 34-7 through OR circuits 13-1 . . . 13-8. The 1st and the 16th output terminals 12-1 and 12-16 of decoder 12 are connected through an OR circuit 14 and an inverter 15 to an AND gate 43 interposed in a circuit connected between the OR circuit 38 and the envelope circuit 39 so that when outputs of the 1st and 16th output terminals 12-1 and 12-16 are "0,0", the AND gate 43 may be opened to allow a tone signal to pass through.

If, now, in the chord discrimination circuit A, the key-switches 1-1 . . . 1-12 are depressed in accordance with a chord, for instance, a G major chord (D,G,E,), its output becomes "001000010001".

Figure 2:
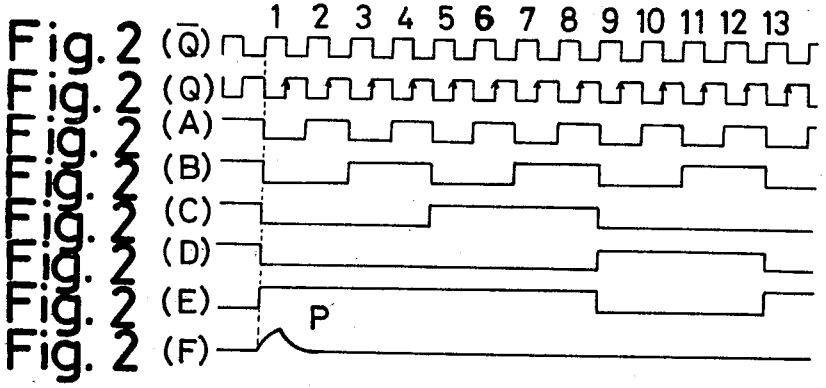
FIG. 2 is a waveform diagram related to the circuits of FIG. 1.

Meanwhile, pulses as shown in FIG. 2 Q are generated sequentially at the 1st output terminal 5*a* of the clock pulse generator 5, and pulses as shown in FIG. 2 $\overline{Q}$ are also generated at the 2nd output terminal 5*b* of the same.

At the output terminals 6*a* . . . 6*d* of the first counter circuit 6, there are obtained as shown in FIG. 2 A . . . D, respective rectangular waves resulted from counting of the pulses Q. These are "0000" "0001" "0010". . . "1011" if represented in digital form, and the same are generated repeatedly. An output as shown in FIG. 2 E is obtained at the output terminal 6*e* of the first counter circuit 6. Thus, the second counter circuit 7 receives the pulses shown in FIG. 2 E repeatedly, from which there are obtained repeatedly "0000" "0001" "0010". . . "1111" at the output terminals 7*a* . . . 7*d*, though not illustrated.

Output terminals of a NOR circuit 16 connected to the output terminals 6*a* . . . 6*d* and 7*a*. . . 7*d* of the first and second counter circuits 6, 7 become "1" when those output terminals 6*a*. . . 6*d* and 7*a*. . . 7*d* are "0", and when the output terminal 5*b* of the clock pulse generator 5 is "1", the output of AND circuit 17 becomes "1", and this output is transformed into a read-in pulse P (FIG. 2 F) through an integrated circuit 18 to be applied to the shift register 2, whereby the output "001000010001" of the key-switches 1-1 . . . 1-12 is held in the shift register 2 and is obtained therefrom. Thus, when an output pulse of the output terminal 5*a* of the clock pulse generator 5 is applied in sequence to the shift register 2, the register 2 is shifted in sequence to "010000100010", "100001000100". . . to be emitted. During this period, such signals as described before are obtained from the output terminals 6*a*. . . 6*d*, 7*a*. . . 7*d* of the first and second counter circuits 6, 7. Meanwhile, the output signals of the output terminals 7*a*. . . 7*d* are applied to the memory circuit 4, and the addresses of the matrix circuit 4*a* are selected from the first address in order by the timing pulses. More in detail, when the output of the output terminals 7*a*. . . 7*d* is "0000", the output of the memory circuit 4 is "0000". Accordingly, during the time when "0000" is maintained, the shifting of shift register 2 makes one round. If, next, "0001" is taken out, the second address of the read-only memory 4*a* is selected and "100000000000" is taken out as shown in Table 1 and is applied to the comparator 3, but a coincidence signal is not taken out because it does not coincide with the output of the shift register 2.

When, subsequently, the shift register 2 makes one round again, "0010" is obtained from the second counter circuit 7, and the third address is selected. Further, "0011" is obtained to select the 4th address and the "0100" is taken out to select the 5th address, whereby "100010010000" is taken out. Next, the signal "001000010001" held first in shift register 2 becomes "100010010000" and is shifted 7 times; it becomes coincident with the output signal of memory circuit 4, whereby a coincidence signal is taken out.

Thus, the first and second latch circuits 8, 9 are latched, and thereupon, the output of the first counter circuit 6 is "0111" and the output of the second counter circuit 7 is "0100", and these output signals are latched by the first and second latch circuits 8, 9 and are emitted.

The output "0111" of the first latch circuit 8 is converted by the decoder 11 into a 12-decimal code and "000001000000" is emitted. Thus, the AND gate 31-6 for G tone is opened, and a tone source signal of 794.3 KHz is applied through the OR circuit 32 to the frequency dividers 33-1 . . . 33-8.

Meanwhile, the output "0100" of the second latch circuit 9 is converted into a 16-decimal code of "0000100000000000". Thus, the signal "1" of the output terminal 12-5 is applied to the AND gate 34-2 through the OR circuits 13-1, 13-4, and the signal "0" of the output terminal 12-13 is applied through an inverter 44 to the AND gate 34-4 as a signal "1". Thus, the AND gates 34-2, 34-4 are opened, and consequently a signal of 1st, a signal of major 3rd and a signal of 5th pass through the AND gates 37-1, 37-2, 37-3, which are opened according to rhythm pulses of the rhythm pulse generator 36, and a rhythm performance is obtained from the speaker 42 through the OR circuit 38, the AND gate 43, the envelope circuit 39, the filter 40 and the amplifier 41.

The decoder 12 has a reset terminal, and when the key depression is released, the output terminal 12-1 becomes "1" and the AND circuit 43 is closed.

The clock pulse oscillator 5 is so arranged as to be of such a high oscillation frequency that the time length from a time instant when the key is depressed to the time instant when the shift register 2 is shifted and a coincidence signal is obtained from the comparator 3, is so short, that a time difference is not felt or appreciated.

If a chord of D minor is depressed at the key-switches 1-1 . . . 1-12, the resulting output is "001001000100".

Meanwhile, as is clear from the Table 1, the memory circuit 4 is "100100010000" in its output, from which the 7th address is selected. If, thus, the shift register 2 is shifted 7 rounds and 2 times, its output becomes "1000100010000", and a coincidence signal is obtained from the comparator 3 and the first and second latch circuits 8, 9 are latched.

By this coincidence signal, the first latch circuit, 8, latches the output "0010" of the first counter circuit 6, and the second latch circuit, 9, latches the output "0110" of the second counter circuit 7, and there are taken out from the decoders 11, 12 "000000000010" and "0000001000000000" respectively.

Thus, the AND gate 31-11 for D tone is opened, and the AND gates 34-1, 34-4 for minor 3rds and 5ths are opened, and there is effected a rhythm performance of D,F,A tones according to the rhythm pulses.

Figure 3:
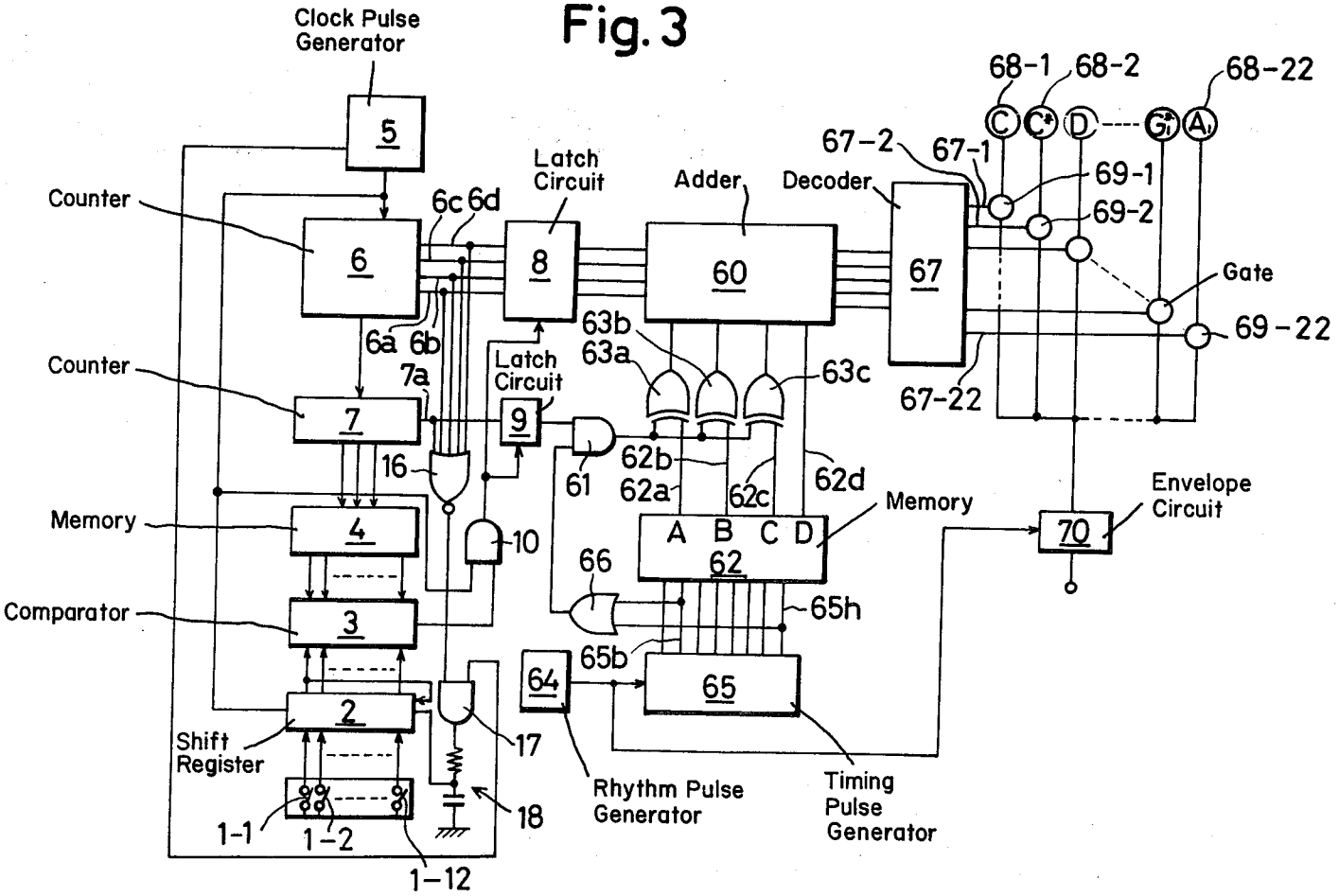
FIG. 3 is a diagram showing another embodiment of the present invention.

FIG. 3 shows another embodiment in which the second counter circuit 7 has a frequency dividing ratio of 2 and it is so arranged that only a changeover between major and minor is effected by an output thereof. The output terminals 6*a*. . . 6*d* of the first counter circuit 6 are connected to multiple input terminals on one side of an adder 60 through the first latch circuit 8. The output terminals 7*a* of the second counter circuit 7 are connected through the second latch circuit 9 to a switching element 61 comprising an AND circuit, and an output terminal of the switching element 61 is connected to input terminals on one side of signal converters, that is, exclusive-OR circuits 63*a*, 63*d*, 63*c* interposed in circuits connecting between output terminals 62*a*. . . 62*d* of a memory circuit 62 and multiple input terminals on the other side of the adder 60. Numeral 64 denotes a rhythm pulse generator, of which an output terminal is connected to a timing pulse generator 65 in order to generate, in sequence, timing pulses at its multiple output terminals, and the multiple output terminals thereof are connected to the above-mentioned memory circuit 62. The memory circuit 62 comprises a read-only memory circuit, for instance, and respective addresses from it are so provided as to memorize, in the form of digital binary codes, chords having relations of 1st, 3rd, 5th, 6th, 5th and 3rd in relation to a root tone as shown in the following Table 3.

TABLE 3

| Degree relation | D | C | B | A |
|---|---|---|---|---|
| 1 degree | 0 | 0 | 0 | 0 |
| 3 degrees | 0 | 1 | 0 | 0 |
| 5 degrees | 0 | 1 | 1 | 1 |
| 6 degrees | 1 | 0 | 0 | 1 |
| 7 degrees | 1 | 0 | 1 | 0 |
| 6 degrees | 1 | 0 | 0 | 1 |
| 5 degrees | 0 | 1 | 1 | 1 |
| 3 degrees | 0 | 1 | 0 | 0 |

The 2nd and 8th output terminals 65*b*, 65*h* of the timing pulse generator 65 are connected through an OR circuit 66 to the AND circuit 61 so that a signal "0100" obtained from the 2nd and 8th addresses of the memory circuit 62 by means of a signal "1" k obtained from the 2nd and 8th output terminals 65*b*, 65*h* may be converted into a minor 3rd "0011" as will be explained in detail hereinafter. The adder 60 comprises a full adder, and an output terminal from it is connected to a binary-coded 22-decimal decoder 67. Plural output terminals 67-1 . . .

67-22 from decoder 67 are connected to control electrodes of respective gate circuits 69-1 . . . 69-22 interposed in output circuits of tone source signal oscillators 68-1 . . . 69-22. Numeral 70 denotes an envelope circuit connected in common to output terminals of the gate circuits 69-1 . . . 69-22, and an output terminal thereof is connected to a speaker through a filter, not illustrated. In this case, the read-only memory of the memory circuit 4 of the chord discrimination circuit A is so provided as to memorize alternately two kinds of C major chord and C minor chord, for instance, as shown in the following Table 4.

TABLE 4

| Tone Name Chord | C | C# | D | D# | E | F | F# | G | G# | A | A# | B |
|---|---|---|---|---|---|---|---|---|---|---|---|---|
| C Major | 1 | 0 | 0 | 0 | 1 | 0 | 0 | 0 | 0 | 0 | 0 | 0 |
| C Major | 1 | 0 | 0 | 1 | 0 | 0 | 0 | 0 | 0 | 0 | 0 | 0 |
| C Major | 1 | 0 | 0 | 0 | 0 | 0 | 0 | 1 | 0 | 0 | 0 | 0 |
| C Major | 1 | 0 | 0 | 1 | 0 | 0 | 0 | 1 | 0 | 0 | 0 | 0 |
| C Major | 1 | 0 | 0 | 0 | 1 | 0 | 0 | 1 | 0 | 0 | 0 | 0 |

If, now, the key-switches 1-1 . . . 1-12 are depressed, for instance, according to G major chord G E, there is obtained an output "00100001000". In almost the same manner as in the above-mentioned first embodiment, this output is held by the shift register 2, and it is shifted in order by the shift pulses. When "100010000000" is obtained from it, the same coincides at the comparator 3 with an output signal of the first address of the memory circuit 4, whereby a concidence signal is generated and the first and second latch circuits 8, 9 are latched.

At that time, "0111" is taken from the output terminals 6*a*. . . 6*d* of the first counter circuit 6. This corresponds to 8 of the 12 chromatic scale, that is, G tone (this becomes a root tone). At that time, an output of the second counter circuit 7 is "0". Thus, when the first address of the memory circuit 62 is selected by an output pulse of the rhythm pulse generator 64, its output is "0000" as shown in Table 3, so that no addition is effected and "0111" is obtained. Thus, by the decoder 67, the 8th gate circuit 69-8 is opened and a musical tone signal of G tone is obtained. When, next, the second address of the memory circuit 62 is selected, "0100" is taken out, and the same is added at the adder 60 to the root tone "0111", so that an output "01011" is obtained, and thus by the decoder 67 and 12th gate circuit 69-12 is opened and there is obtained a musical tone signal of B tone. In this manner, if the words in the memory circuit 62 as shown in Table 3 are taken out in order, G.B.D.E.F.E.D.B. are obtained as a broken chord according to rhythm pulses of the rhythm pulse generator 64.

If, then, C minor chord CD# is depressed, there is obtained an output "100100000000". When the shift register 2 is shifted one round by shift pulses and an output "100100000000" is obtained at the beginning of the second round thereof, the same becomes coincident with an output "100100000000" obtained from the 2nd address of the memory circuit 4, and there is obtained a coincidence signal. At that time, an output signal of the first counter circuit 6 is "0000", and an output signal of the second counter circuit 7 is "1". Thus, if the first address of the memory circuit 62 is selected by a signal "1" of the first output terminal 65*a* of the decoder 65 by means of output pulses of the rhythm pulse generator 64, there is taken out "0000", and "00000" is taken out from the adder 60, whereby "100....." is obtained from the decoder 67 and the gate circuit 69-1 for the C tone is opened. If, next, "1" is obtained at the 2nd output terminal 65*b* of the decoder 65, the 2nd address is selected and "0100" is taken out. The output "1" of the 2nd output terminal 65*b* is added to the exclusive-OR circuits 63*a*, 63*b*, 63*c* through the AND circuit 61, so that the word of the 2nd address is converted into "0011". Thus, the gate circuit 69-4 for a minor 3rd, that is, D# tone is opened so as to obtain a tone of the minor 3rd. Thereafter, in almost the same manner as described before in connection with the case of G chord, additions of a 5th, 6th, 7th, 6th, 5th and a minor 3rd are in order effected, whereby a broken chord of D minor is obtained.

In the embodiment of FIG. 3, the decoders 65, 67 have also reset terminals in almost the same manner as in the case of the first embodiment of FIG. 1. Further, the rhythm pulse generator 64 is so arranged that it may be driven from a time instant when a key is depressed.

Figure 4:
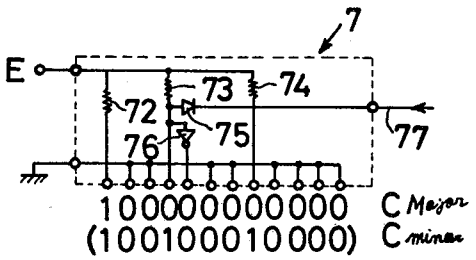
FIG. 4 is a circuit diagram showing a further embodiment.

The above has been explained with reference to a case in which several chords are memorized in the memory circuit 4. However, if it is intended that two kinds of C major chord CEG and C minor chord C D# G, for instance, be memorized, it can be simply constructed by using resistances 72, 73, 74, a diode 75, and an inverter 76 as shown, for instance, in FIG. 4. Numeral 77 denotes an input terminal connected to the output terminal of the 2nd counter circuit 7 in FIG. 3.

Thus, the output is "100010010000" when the input terminal is "0", and the output is "100100010000" when the input terminal is "0".

Thus, according to the present invention, only by causing the memory circuit to memorize any desired number of basic types of chords, many kinds of chords can be discriminated and it becomes possible to obtain automatic musical performances of various chords.

Without further analysis the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalents of the following claims.

What is claimed is:

1. An automatic musical instrument comprising a chord discrimination circuit; a musical performance circuit connected to an output side of the chord discrimination circuit; a comparator having multiple input terminals on one side; a memory circuit connected to said multiple input terminals on said one side of said comparator; said memory circuit having multiple basic types of chords in memory; said comparator having multiple input terminals on another side; a shift register; key-switches connected to said multiple input terminals of said other side of said comparator through said shift register; a clock pulse generator connected to a control electrode of said shift register, said memory circuit having multiple input terminals; first and second counter circuits, said clock pulse generator being connected to said multiple input terminals of said memory circuits through said first and second counter circuits; said first and second counter circuits having multiple output terminals; first and second latched circuits connected respectively to said output terminals of said first and second counter circuits; said comparator having an output terminal connected to control electrodes of said first and second latch circuits, said first and second latched circuits being connected to said musical performance circuit.

2. An automatic musical instrument as defined in claim 1 wherein said musical performance circuit comprises a decoder connected to multiple output terminals of said first latch circuit; a plurality of AND gates connected to multiple output terminals of said decoder; a plurality of tone source signal oscillators having different frequencies of oscillation; a plurality of frequency dividers connected to output terminals of said oscillators through respective ones of said AND gates; a decoder connected to multiple output terminals of said second latch circuit; an amplifier a rhythm pulse generator; and a plurality of gate circuits connected between said amplifier and output terminals of said frequency dividers, said gate circuits being controlled to open and closed states by outputs of said decoder and said rhythm pulse generator.

3. An automatic musical instrument as defined in claim 2 wherein said frequency dividers comprise a frequency divider for lst, a frequency divider for minor 3rd, a frequency divider for major 3rd, a frequency divider for diminished 5th, a frequency divider for perfect 5th, a frequency divider for 6th, a frequency divider for minor 7th and a frequency divider for major 7th.

4. An automatic musical instrument as defined in claim 1 wherein said performance circuit comprises a timing pulse generator for generating timing pulses in sequence at multiple output terminals of said generator; a rhythm pulse generator generating a series of output pulses cooperating with said timing pulse generator for generating said timing pulses; a memory circuit having addresses selected in sequence by said timing pulses; an adder having multiple input terminals connected on one side to multiple output terminals of said memory circuit; a decoder connected to multiple output terminals of said adder; musical tone signal passing circuits; a plurality of gate circuits connected to multiple output terminals of said decoder; said gate circuits being interposed in respective ones of said musical tone signal passing circuits; signal convertors connected between selected ones of circuits between multiple output terminals of said memory circuit and said adder; switching elements; selected output terminals of said timing pulse generator being connected to respective control electrodes of said signal convertors through said switching elements; said first latch circuit having multiple output terminals connected to multiple input terminals connected on another side of said adder; said second latch circuit having multiple output terminals connected to control electrodes of said switching elements.

5. An automatic musical instrument as defined in claim 4 wherein said signal convertors comprise exclusive OR circuits.

* * * * *

UNITED STATES PATENT AND TRADEMARK OFFICE

CERTIFICATE OF CORRECTION

PATENT NO. : 4,138,918

DATED : February 13, 1979

INVENTOR(S) : Hiroshi Kato

It is certified that error appears in the above-identified patent and that said Letters Patent is hereby corrected as shown below:

On the title page, after Item [22], the following should appear:

--[30] Foreign Application Priority Data

May 13, 1976 [JP] Japan..... 51-53822--.

Signed and Sealed this

Twenty-first Day of April, 1992

*Attest:*

HARRY F. MANBECK, JR.

*Attesting Officer*

*Commissioner of Patents and Trademarks*